US010406060B2

(12) United States Patent
Uto et al.

(10) Patent No.: US 10,406,060 B2
(45) Date of Patent: Sep. 10, 2019

(54) BODY-WEIGHT-SUPPORTED GAIT LIFT

(71) Applicant: MORITOH CO., LTD., Ichinomiya-shi (JP)

(72) Inventors: Yoshitsugu Uto, Niwa-gun (JP); Tetsuya Fujita, Ichinomiya (JP); Katsumi Morishima, Ichinomiya (JP)

(73) Assignee: MORITOH CO., LTD., Ichinomiya-Shi, Aichi (JP)

( * ) Notice: Subject to any disclaimer, the term of this patent is extended or adjusted under 35 U.S.C. 154(b) by 25 days.

(21) Appl. No.: 15/523,643

(22) PCT Filed: Jan. 28, 2015

(86) PCT No.: PCT/JP2015/052361
§ 371 (c)(1),
(2) Date: May 1, 2017

(87) PCT Pub. No.: WO2016/121031
PCT Pub. Date: Aug. 4, 2016

(65) Prior Publication Data

US 2017/0312163 A1 Nov. 2, 2017

(51) Int. Cl.
*A61H 3/00* (2006.01)
*A63B 24/00* (2006.01)

(52) U.S. Cl.
CPC ..... *A61H 3/008* (2013.01); *A63B 24/0087* (2013.01); *A61H 2201/0176* (2013.01);
(Continued)

(58) Field of Classification Search
CPC ..... A61H 3/008; A61H 2201/503; A61H 2201/1652; A61H 2201/5079;
(Continued)

(56) References Cited

U.S. PATENT DOCUMENTS

2008/0287268 A1* 11/2008 Hidler ..... A61H 3/008 482/69

FOREIGN PATENT DOCUMENTS

JP S 61-181463 A 8/1986
JP H 08-198600 A 8/1996
(Continued)

OTHER PUBLICATIONS

English translation of Japanese Office Action in Japanese Application No. 2013-158280 dated Aug. 2, 2016.
(Continued)

*Primary Examiner* — Megan Anderson
(74) *Attorney, Agent, or Firm* — McGinn I.P. Law Group, PLLC

(57) ABSTRACT

A lifting device is hung in a manner relatively displaceable in the front-and-rear direction within a predetermined range with respect to the travel base that can be self-propelled in the front-and-rear direction, and a control device is provided with respect to the travel base. The control device causes the travel base to be self-propelled forward when the gait trainee moves forward and thus the lifting device is relatively displaced forward with respect to the travel base within the predetermined range, and causes self-propelling of the travel base to stop when the travel base is self-propelled forward faster than the gait trainee moves and then the lifting device is relatively displaced rearward with respect to the travel base within the predetermined range, thereby causing the travel base to be self-propelled forward in accordance with a pace of the gait trainee.

11 Claims, 10 Drawing Sheets

(52) U.S. Cl.
CPC ..... *A61H 2201/1207* (2013.01); *A61H 2201/1652* (2013.01); *A61H 2201/1664* (2013.01); *A61H 2201/503* (2013.01); *A61H 2201/5005* (2013.01); *A61H 2201/5058* (2013.01); *A61H 2201/5079* (2013.01); *A61H 2201/5084* (2013.01); *A61H 2201/5092* (2013.01)

(58) Field of Classification Search
CPC .... A61H 2201/5005; A61H 2201/5058; A61H 2201/1664; A61H 2201/0176; A61H 2201/5084; A61H 2201/1207; A61H 2201/5092; A63B 24/0087
See application file for complete search history.

(56) References Cited

FOREIGN PATENT DOCUMENTS

| | | | |
|---|---|---|---|
| JP | H 11-113986 | A | 4/1999 |
| JP | 2003-325601 | A | 11/2003 |
| JP | 2011-083460 | A | 4/2011 |
| JP | 2011-110301 | A | 6/2011 |
| JP | 3194859 | U | 12/2014 |
| WO | WO 2009/023321 | A2 | 2/2009 |

OTHER PUBLICATIONS

Notification Concerning Transmittal of International Preliminary Report on Patentability (PCT/IB/326) in PCT Application No. PCT/JP2015/052361 dated Aug. 10, 2017 (and English translation of Written Opinion).
International Preliminary Report on Patentability (PCT/IB/373) in PCT Application No. PCT/JP2015/052361 dated Aug. 10, 2017.
Notification of Transmittal of Translation of the International Preliminary Report on Patentability (PCT/IB/338) in PCT Application No. PCT/JP2015/052361 dated Aug. 10, 2017.
Translation of International Preliminary Report on Patentability in PCT Application No. PCT/JP2015/052361 dated Aug. 10, 2017.
Japanese Office Action in Japanese Application No. 2013-158280 dated Aug. 2, 2016 (English translation was previously submitted on Jun. 7, 2017).
Second and Supplementary Notice Informing the Applicant of the Communication of the International Application PCT/IB/308 (Second and Supplementary Notice) in Application No. PCT/JP2015/052361 dated Jun. 1, 2017.
International Search Report (ISR) (PCT Form PCT/ISA/210), in PCT/JP2015/052361, dated Apr. 28, 2015.

* cited by examiner 1
10
20
35
31
60
30
T 1
10
20
30
T 1
10
51
20
30
T 1
10
20
52
30
T

BODY-WEIGHT-SUPPORTED GAIT LIFT

TECHNICAL FIELD

The present invention relates to a body-weight-supported gait device that is used to reduce part of body weight loaded on the legs of a gait trainee when gait training is performed.

BACKGROUND ART

When gait training is performed for rehabilitation, for example, during convalescence from a stroke or a leg injury, many gait trainees experience difficulty in supporting their body weight because they cannot put their strength into their legs. In such cases, if part (e.g., 20 kg) of body weight (e.g., 60 kg) loaded on legs can be reduced (e.g., down to 40 kg), gait training can be easily performed, and thus body-weight-supported gait devices that support body weight to perform gait training have been proposed. Examples of the body-weight-supported gait devices include a body-weight-supported gait lift 80 of a conventional example 1 (Patent Document 1) depicted in FIG. 8 and a body-weight-supported gait lift 90 of a conventional example 2 (Patent Documents 2 and 3) depicted in FIGS. 9A to 9D.

The body-weight-supported gait lift 80 of the conventional example 1 depicted in FIG. 8 includes a movable frame 82 and a lifting device 83. The movable frame 82 is placed on a floor via casters 81 so as to be displaceable in a front-and-rear direction, and an upper portion of the movable frame 82 extends above the head of a gait trainee T. The lifting device 83 is hung on the upper portion of the movable frame 82 and lifts the gait trainee T to support his/her body weight. When the gait trainee T walks forward while pushing the movable frame 82 forward, the movable frame 82 moves forward together with the gait trainee T.

The body-weight-supported gait lift 90 of the conventional example 2 depicted in FIGS. 9A to 9D includes: a rail 91 that is provided in a position above the head of a gait trainee T and extends in a front-and-rear direction; a travel base 92 that is attached to the rail 91 in a manner capable of being self-propelled; and a lifting device 93 that is hung on the travel base 92 and lifts the gait trainee T to reduce part of his/her body weight loaded on the legs of the gait trainee T. The gait trainee T manually operates the travel base 92 with a control panel (not depicted), whereby the travel base 92 is caused to move forward in accordance with his/her pace.

PRIOR ART DOCUMENTS

Patent Documents

Patent Document 1: Japanese Patent Application Publication No. 2011-83460

Patent Document 2: Japanese Patent Application Publication No. 2003-325601

Patent Document 3: Japanese Patent Application Publication No. H11-113986

SUMMARY OF THE INVENTION

Problem to be Solved by the Invention

However, in the body-weight-supported gait lift 80 of the conventional example 1, when the gait trainee T moves forward, the movable frame 82 needs to be pushed forward so that the movable frame 82 is caused to move forward together with himself/herself, which requires a greater force to be applied forward during this forward movement. When the gait trainee T stops, the movable frame 82 needs to be pulled so that the movable frame 82 is decelerated together with him/her, which also requires a greater force to be applied rearward during this stopping.

In the body-weight-supported gait lift 90 of the conventional example 2, the travel base 92 is self-propelled and thus, unlike in the conventional example 1, the gait trainee T does not have to apply forward force to the travel base 92 by himself/herself when moving forward, and does not have to apply rearward force to the travel base 92 by himself/herself when stopping. Thus, force required to be applied forward when the gait trainee T moves forward and force required to be applied rearward when he/she stops are not great.

However, because the gait trainee T needs to manually operate the travel base 92 to cause the travel base 92 to move forward in accordance with his/her pace, this manual operation is troublesome, and accordingly the gait trainee T cannot focus exclusively on walking.

Furthermore, if the gait trainee T fails to adjust the self-propelled speed of the travel base 92 to his/her pace due to poor manual operation, the gait trainee T is pulled forward or rearward by the travel base 92 to receive impact as depicted in FIGS. 10A and 10B. Such situations are more likely to occur especially when the gait trainee T starts walking or stops walking.

In view of this, an object of the invention is to eliminate the need for a gait trainee to manually operate a travel base in accordance with his/her pace while allowing the travel base to be self-propelled and suppressing force required to be applied forward when a gait trainee moves forward and force required to be applied rearward when the gait trainee stops, and also to prevent the gait trainee from being pulled forward or rearward by the travel base even if the self-propelled speed of the travel base does not perfectly match the pace of the gait trainee.

Means for Solving the Problem

In order to accomplish this object, a body-weight-supported gait lift of the present invention includes: a rail that is provided in a position above the head of a gait trainee and extends in a front-and-rear direction; a travel base that is attached to the rail in a manner capable of being self-propelled; and a lifting device that is hung on the travel base and lifts the gait trainee to reduce part of his/her body weight loaded on the legs of the gait trainee. In the body-weight-supported gait lift, the lifting device is hung in a manner relatively displaceable in the front-and-rear direction with respect to the travel base within a predetermined range. The body-weight-supported gait lift further includes a control device that causes the travel base to be self-propelled forward when the gait trainee moves forward and thus the lifting device is relatively displaced forward with respect to the travel base within the predetermined range, and causes self-propelling of the travel base to stop when the travel base is self-propelled forward faster than the gait trainee moves and then the lifting device is relatively displaced rearward with respect to the travel base within the predetermined range, thereby causing the travel base to be self-propelled forward in accordance with a pace of the gait trainee.

With this structure, the travel base can be self-propelled and the lifting device can be relatively displaced in the front-and-rear direction with respect to the travel base within the predetermined range. Accordingly, the gait trainee does not apply forward force to the travel base by himself/herself when moving forward and does not apply rearward force to the travel base by himself/herself when stopping. In addition, the control device causes the travel base to be self-propelled in accordance with the pace of the gait trainee. Accordingly, the gait trainee does not have to manually operate the travel base in accordance with his/her pace. Furthermore, The lifting device can be relatively displaced in the front-and-rear direction with respect to the travel base within the predetermined range. Accordingly, even if the self-propelled speed of the travel base does not perfectly match the pace of the gait trainee, the gait trainee is not pulled forward or rearward by the travel base when the lifting device is within the predetermined range.

The control device may be a control device that causes the travel base to be self-propelled only forward in accordance with the pace of the gait trainee, but is preferably a control device of a mode described below so that the gait trainee can turn around to move rearward when having moved forward to the front end of the rail. Specifically, the control device of this mode causes the travel base to be self-propelled rearward when the gait trainee moves rearward and thus the lifting device is relatively displaced rearward with respect to the travel base within the predetermined range, and causes self-propelling of the travel base to stop when the travel base is self-propelled rearward faster than the gait trainee moves and then the lifting device is relatively displaced forward with respect to the travel base within the predetermined range, thereby causing the travel base to be self-propelled rearward in accordance with the pace of the gait trainee.

Examples of a method for detecting relative displacement of the lifting device with respect to the travel base include, but are not limited to, the following modes [a] to [c].

Mode [a] in which the control device detects the relative position of the lifting device with respect to the travel base, thereby detecting the relative displacement.

Mode [b] in which the control device detects the relative speed of the lifting device with respect to the travel base, thereby detecting the relative displacement.

Mode [c] in which the control device detects the acceleration of the lifting device, thereby detecting the relative displacement of the lifting device with respect to the travel base.

Herein, the mode [a] is preferable because the relative position can be more easily detected than the relative speed or the acceleration.

Examples of a specific mode of the control device in the mode [a] (case in which the relative position is detected) include, but are not limited to, the following modes [i] and [ii].

Mode [i] in which the control device includes: a stop sensor that detects that the lifting device has reached a predetermined reference position with respect to the travel base; a forward-movement sensor that detects that the lifting device has reached a forward position anterior to the reference position; and a rearward-movement sensor that detects that the lifting device has reached a rearward position posterior to the reference position. In this mode, the travel base is caused to be self-propelled forward upon detection by the forward-movement sensor, the travel base is caused to be self-propelled rearward upon detection by the rearward-movement sensor, and self-propelling of the travel base is stopped upon detection by the stop sensor.

Mode [ii] in which the control device includes: a forward-movement sensor that detects that the lifting device has reached a predetermined forward position with respect to the travel base; and a rearward-movement sensor that detects that the lifting device has reached a rearward position posterior to the forward position. In this mode, in a predetermined forward-movement mode, the travel base is caused to be self-propelled forward upon detection by the forward-movement sensor and self-propelling of the travel base is stopped upon detection by the rearward-movement sensor, and in a predetermined rearward-movement mode, the travel base is caused to be self-propelled rearward upon detection by the rearward-movement sensor and self-propelling of the travel base is stopped upon detection by the forward-movement sensor. Herein, the movement mode may be switched by manual operation between the forward-movement mode and the rearward-movement mode, or may be switched automatically when the gait trainee has moved forward to the front end of the rail or when the gait trainee has moved rearward to the rear end thereof.

Each sensor may be a contact sensor in which detection is performed in contact with the lifting device, for example, but is preferably a noncontact sensor in which detection is performed without such contact, for example. This is because resistance when the gait trainee moves forward or moves rearward is low. Examples of the noncontact sensor include, but are not limited to, an infrared sensor.

Examples of a specific modes of the control device in the mode [b] (case in which the relative speed is detected) include, but are not limited to, the following mode. That is a mode in which the control device includes a speed sensor that detects the relative speed of the lifting device with respect to the travel base, and the travel base is accelerated when the detected relative speed is positive and the travel base is decelerated when the detected relative speed is negative.

Examples of a specific mode of the control device in the mode [c] (case in which the acceleration is detected), but are not limited to, the following mode. That is a mode in which the control device includes a gravity sensor that detects the acceleration of the lifting device, and the travel base is accelerated when the detected acceleration of the lifting device is positive and the travel base is decelerated when the detected acceleration of the lifting device is negative.

Although components of the body-weight-supported gait lift of the present invention other than those described above are not particularly limited, a hoisting device that hoists the lifting device is preferably attached to the travel base. This is because such a hoisting device facilitates height adjustment of the lifting device.

Examples of a mode of the hoisting device include, but are not limited to, the following mode. That is a mode in which the travel base includes a shaft extending in the front-and-rear direction, an upper portion of the lifting device is engaged with the shaft in a manner relatively displaceable in the front-and-rear direction and relatively non-displaceable in a circumferential direction so that the lifting device is hung on the travel base, and the hoisting device rotates the shaft to hoist the lifting device.

Effects of the Invention

With the body-weight-supported gait lift of the present invention, the travel base can be self-propelled and the lifting device can be relatively displaced in the front-and-rear direction with respect to the travel base within the predetermined range. Accordingly, unlike the conventional example 1, the gait trainee does not apply forward force to the travel base by himself/herself when moving forward and does not apply rearward force to the travel base by himself/herself when stopping. Thus, force required to be applied forward when the gait trainee moves forward and force required to be applied rearward when the gait trainee stops are not great.

In addition, the control device causes the travel base to be self-propelled in accordance with the pace of the gait trainee. Accordingly, unlike the conventional example 2, the travel base is self-propelled in accordance with the pace without manual operation of the travel base by the gait trainee. Thus, the gait trainee can focus exclusively on walking.

Furthermore, the lifting device can be relatively displaced in the front-and-rear direction with respect to the travel base within the predetermined range. Accordingly, even if the self-propelled speed of the travel base does not perfectly match the pace of the gait trainee, unlike the conventional example 2, the gait trainee is not pulled forward or rearward by the travel base when the lifting device is within the predetermined range.

MODES FOR CARRYING OUT THE INVENTION

Figure 1A:
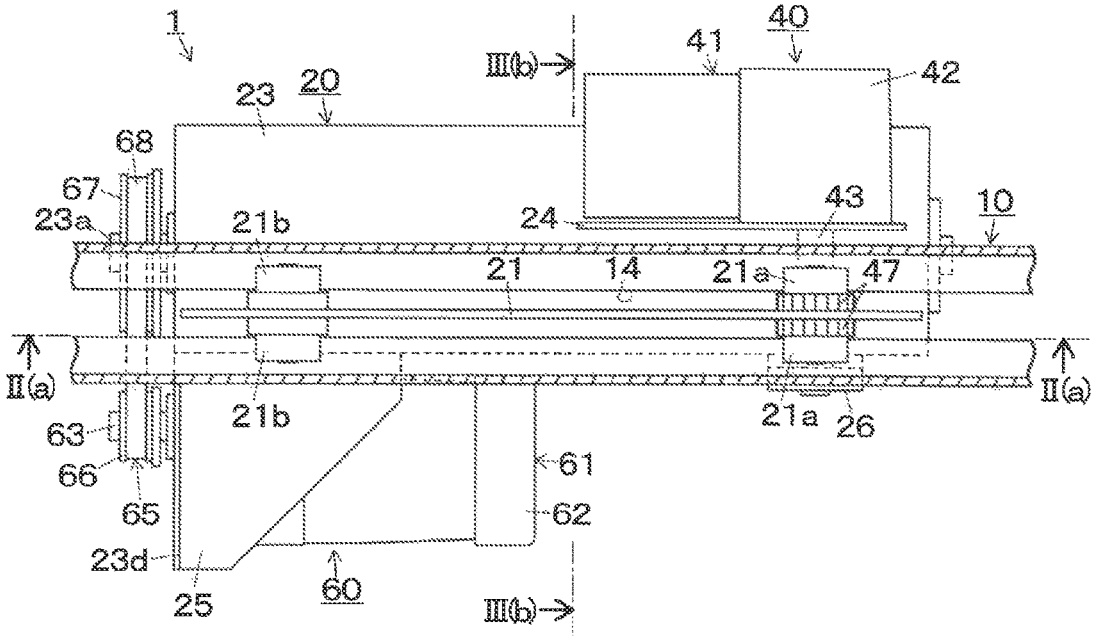
FIG. 1A is a plan sectional view (upper portion) and FIG. 1B is a plan sectional view (lower portion), both illustrating a body-weight-supported gait lift of an embodiment 1.
Figure 1B:
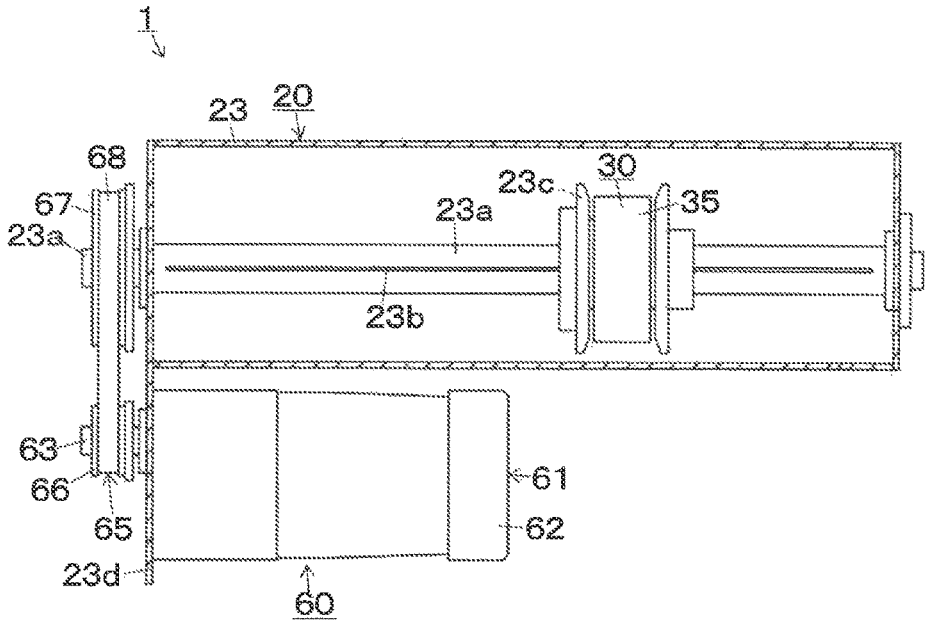
Figure 2A:
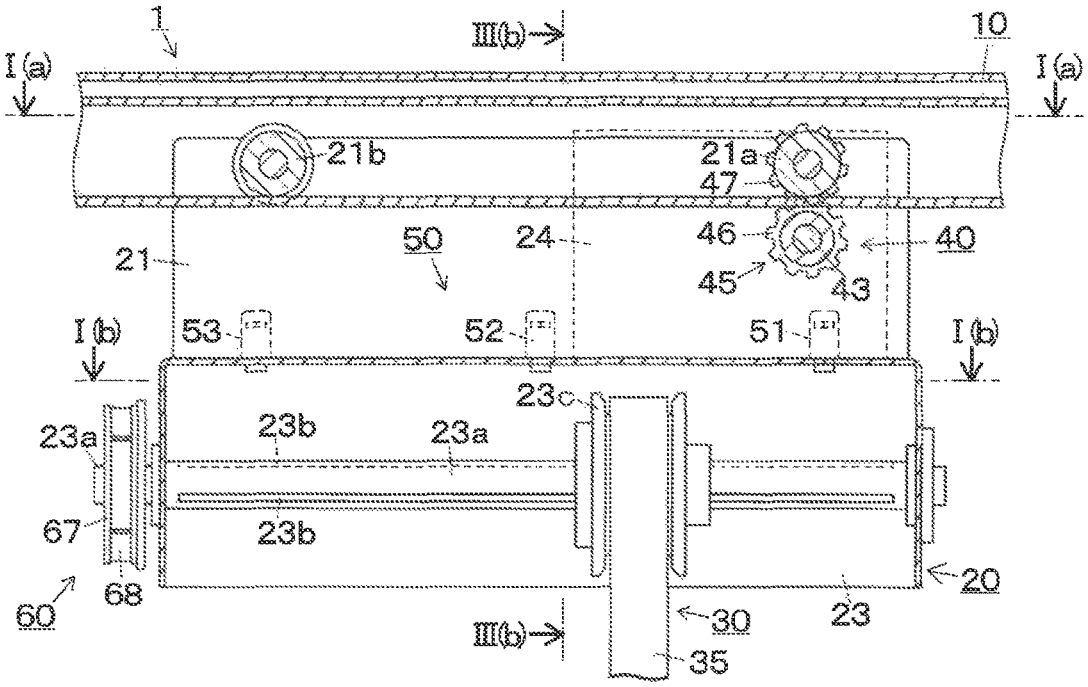
FIG. 2A is a side sectional view and FIG. 2B is a side view, both illustrating the body-weight-supported gait lift of the embodiment 1.
Figure 2B:
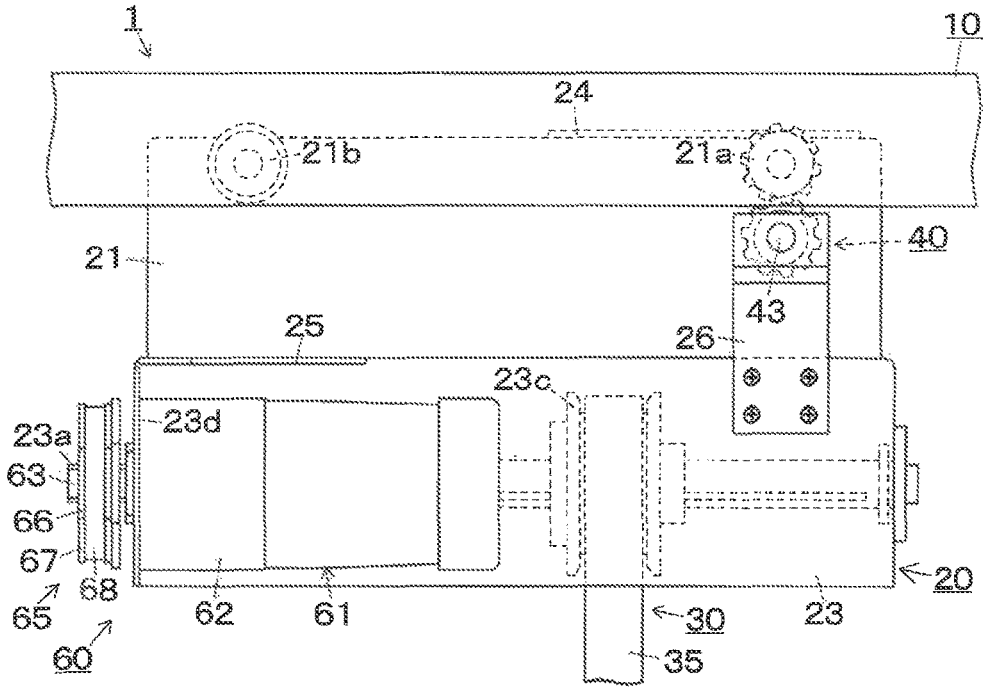
Figure 3B:
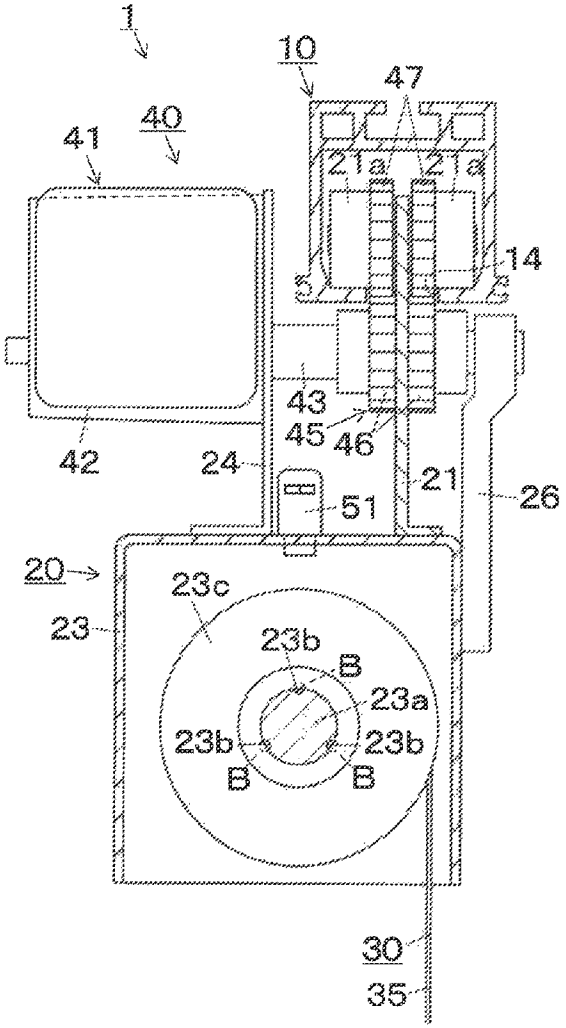
FIG. 3A is a rear view and FIG. 3B is a rear sectional view, both illustrating the body-weight-supported gait lift of the embodiment 1.
Figure 3A:
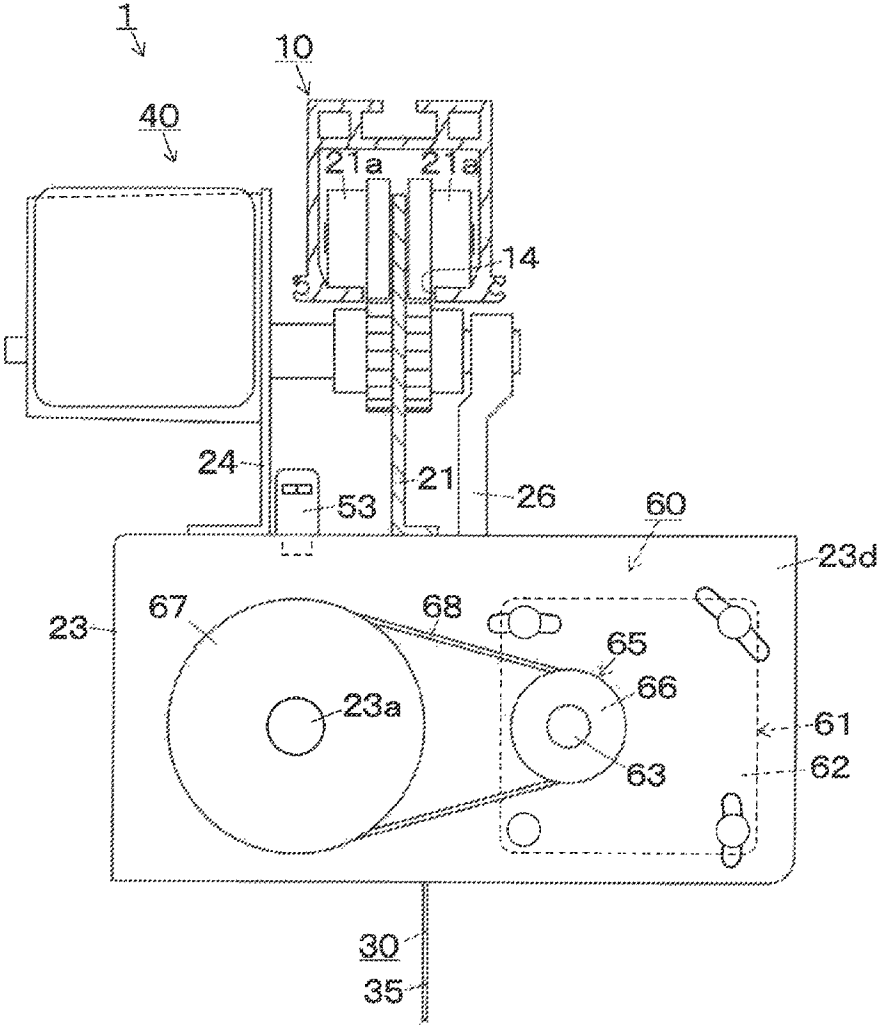

A body-weight-supported gait lift of the present invention will now be described with reference to the drawings. In the following description, one side of the longitudinal direction of a rail is called "front" and the other side thereof is called "rear", and one side of the width direction of the rail is called "left" and the other side thereof is called "right". Herein, the body-weight-supported gait lift may be designed oppositely in the right-and-left direction.

Embodiment 1

A body-weight-supported gait lift 1 of an embodiment 1 depicted in FIGS. 1A to 5D includes a rail 10, a travel base 20, a lifting device 30, a self-propelled device 40, a control device 50, and a hoisting device 60 described below.

[Rail 10]

The rail 10 is a hollow member having a rectangular cross-section and extending in the front-and-rear direction and is installed in a position above the head of a gait trainee T. A slit 14 extending in the front-and-rear direction is formed in a central portion of a lower-end portion of the rail in the right-and-left direction.

[Travel Base 20]

The travel base 20 is a member that is attached to the rail 10 in a manner displaceable in the front-and-rear direction. This travel base 20 includes a rail engaging frame 21, a main frame 23, a self-propelled-device supporting frame 24, a hoisting-device protecting frame 25, and an auxiliary frame 26 described below.

The rail engaging frame 21 is a plate-shaped frame that extends in the vertical direction and the front-and-rear direction, an upper portion thereof is disposed inside the rail 10 through the slit 14. To an upper portion of this rail engaging frame 21, front rollers 21*a*, 21*a* and rear rollers 21*b*, 21*b* are rotatably attached with a spacing therebetween in the front-and-rear direction. In the rail 10, the front rollers 21*a*, 21*a* and the rear rollers 21*b*, 21*b* are in contact with an upper surface of the lower-end portion of the rail 10 from above, whereby the travel base 20 is engaged with the rail 10 in a manner displaceable in the front-and-rear direction.

The main frame 23 is a box-shaped frame that is open downward, and is joined to a lower-end portion of the rail engaging frame 21. Inside this main frame 23, a shaft 23*a* having a circular cross-section and extending in the front-and-rear direction is attached so as to rotate in its circumferential direction. On the outer peripheral surface of this shaft 23*a*, rotation-preventing grooves 23*b*, 23*b*, 23*b* extending in the front-and-rear direction are formed in a recessed manner. A reel 23*c* is fitted onto the shaft 23*a*. The rotation-preventing grooves 23*b*, 23*b*, 23*b* are engaged with bearings B, B, B that are attached to recessed portions (not depicted) formed in the inner peripheral surface of the reel 23*c* and protrude from the inner peripheral surface. Accordingly, the reel 23*c* is attached to the shaft 23*a* in a manner relatively displaceable in the front-and-rear direction and relatively non-displaceable in the circumferential direction. The reel 23*c* is provided with a locking portion (not depicted) that locks an upper-end portion of the lifting device 30. On a rear-end portion of the main frame 23, a plate-shaped hoisting-device supporting protrusion 23*d* is formed that protrudes rightward and extends in the vertical direction and the right-and-left direction.

The self-propelled-device supporting frame 24 is a plate-shaped frame provided on the left side of the rail engaging frame 21 and extending in the vertical direction and the front-and-rear direction, and a lower-end portion thereof is joined to an upper surface of the main frame 23. The hoisting-device protecting frame 25 is a plate-shaped frame attached to an upper-end portion of a right side surface of the main frame 23, protruding rightward from the upper-end portion of the right side surface, and extending in the right-and-left direction and the front-and-rear direction. The auxiliary frame 26 is a plate-shaped frame attached to an upper portion of the right side surface of the main frame 23, extending in the vertical direction, and having a width in the front-and-rear direction.

[Lifting Device 30]

The lifting device 30 is a member (sling seat) that lifts the gait trainee T to reduce part of body weight loaded on the legs of the gait trainee T. This lifting device 30 includes a lifting-device main part 31 that surrounds and holds the gait trainee T and a strap 35 that extends upward from the lifting-device main part 31. The upper-end portion of the strap 35 is locked by the locking portion (not depicted) of the reel 23*c*, and thus the upper portion of the strap 35 is attached to the shaft 23*a* via the reel 23*c* in a manner relatively displaceable in the front-and-rear direction and relatively non-displaceable in the circumferential direction. Consequently, the lifting device 30 is hung in a manner relatively displaceable in the front-and-rear direction with respect to the travel base 20 within a predetermined range.

[Self-Propelled Device 40]

The self-propelled device 40 is a device that is attached to the travel base 20 and drives the travel base 20 in the front-and-rear direction, thereby causing the travel base 20 to be self-propelled in the front-and-rear direction. This self-propelled device 40 includes a self-propelling motor 41 and a power transmission mechanism 45 described below.

The self-propelling motor 41 is a motor serving as a power source for driving the travel base 20 in the front-and-rear direction. This self-propelling motor 41 includes: a motor body that is attached to a left side surface of the self-propelled-device supporting frame 24; and a motor rod 43 that extends rightward from the motor body 42 to penetrate the self-propelled-device supporting frame 24, supported at aright end portion thereof by an upper portion of the auxiliary frame 26. The motor body 42 rotationally drives the motor rod 43 to output power.

The power transmission mechanism 45 is a mechanism that transmits power of the self-propelling motor 41 to the front rollers 21*a*, 21*a* to rotate the front rollers 21*a*, 21*a*. This power transmission mechanism 45 includes: first gears 46, 46 that are attached to a longitudinally intermediate portion of the motor rod 43 of the self-propelling motor 41 to rotate together with the motor rod 43; and second gears 47, 47 that are attached to side surfaces of the front rollers 21*a*, 21*a* to rotate together with the front rollers 21*a*, 21*a*. The first gears 46, 46 mesh with the second gears 47, 47.

[Control Device 50]

The control device 50 is a device that causes the travel base 20 to be self-propelled forward when the gait trainee T moves forward and thus the lifting device 30 is relatively displaced forward with respect to the travel base 20 within the predetermined range, and causes self-propelling of the travel base 20 to stop when the travel base 20 is self-propelled forward faster than the gait trainee T moves and then the lifting device 30 is relatively displaced rearward with respect to the travel base 20 within the predetermined range. The control device 50 thus causes the travel base 20 to be self-propelled forward in accordance with the pace of the gait trainee T. This control device 50 is also a device that causes the travel base 20 to be self-propelled rearward when the gait trainee T moves rearward and thus the lifting device 30 is relatively displaced rearward with respect to the travel base 20 within the predetermined range, and causes self-propelling of the travel base 20 to stop when the travel base 20 is self-propelled rearward faster than the gait trainee T moves and then the lifting device 30 is relatively displaced forward with respect to the travel base 20 within the predetermined range. The control device 50 thus causes the travel base 20 to be self-propelled rearward in accordance with the pace of the gait trainee T. The control device 50 includes a stop sensor 52, a forward-movement sensor 51, a rearward-movement sensor 53, and a controller (not depicted) described below.

The stop sensor 52 is an infrared sensor that detects with infrared rays that the reel 23*c* has reached a predetermined reference position with respect to the shaft 23*a*, that is, the lifting device 30 has reached the predetermined reference position with respect to the travel base 20, and that transmits a stop signal to the controller (not depicted). This stop sensor 52 is attached to an upper portion of an intermediate portion of the main frame 23 in the front-and-rear direction.

The forward-movement sensor 51 is an infrared sensor that detects with infrared rays that the reel 23*c* has reached a forward position anterior to the reference position with respect to the shaft 23*a*, that is, the lifting device 30 has reached the forward position anterior to the reference position with respect to the travel base 20, and that transmits a forward-movement signal to the controller (not depicted). This forward-movement sensor 51 is attached to an upper portion of the main frame 23 in a position anterior to the stop sensor 52.

The rearward-movement sensor 53 is an infrared sensor that detects with infrared rays that the reel 23*c* has reached a rearward position posterior to the reference position with respect to the shaft 23*a*, that is, the lifting device 30 has reached the rearward position posterior to the reference position with respect to the travel base 20, and that transmits a rearward-movement signal to the controller (not depicted). This rearward-movement sensor 53 is attached to an upper portion of the main frame 23 in a position posterior to the stop sensor 52.

The controller (not depicted) is a such device that causes the self-propelling motor 41 to rotate in one direction thereby causing the travel base 20 to be self-propelled forward when receiving a forward-movement signal from the forward-movement sensor 51, causes the self-propelling motor 41 to rotate in the opposite direction thereby causing the travel base 20 to be self-propelled rearward when receiving a rearward-movement signal from the rearward-movement sensor 53, and causes the self-propelling motor 41 to stop thereby causing self-propelling of the travel base 20 to stop when receiving a stop signal from the stop sensor 52. This controller (not depicted) is attached to the self-propelling motor 41.

[Hoisting Device 60]

The hoisting device 60 is a device that rotates the shaft 23*a* in its circumferential direction thereby rotating the reel 23*c* to hoist the lifting device 30. This hoisting device 60 includes a hoisting motor 61 and a hoisting-force transmission mechanism 65 described below.

The hoisting motor 61 is a motor serving as a power source for hoisting the lifting device 30. This hoisting motor 61 includes a motor body 62 that is attached to a front surface of the hoisting-device supporting protrusion 23*d* of the main frame 23 and a motor rod 63 that extends rearward from the motor body 62 to penetrate the hoisting-device supporting protrusion 23*d*. The motor body 62 rotationally drives the motor rod 63 to output power.

The hoisting-force transmission mechanism 65 is a mechanism that transmits power of the hoisting motor 61 to the shaft 23*a* to rotate the shaft 23*a* in its circumferential direction. This hoisting-force transmission mechanism 65 includes: a first pulley 66 that is attached to a rear-end portion of the motor rod 63 of the hoisting motor 61 to rotate together with the motor rod 63; a second pulley 67 that is attached to a rear-end portion of the shaft 23*a* to rotate together with the shaft 23*a*; and a belt 68 that is looped over the first pulley 66 and the second pulley 67.

The following describes a situation in which gait training is performed with the body-weight-supported gait lift 1 of the embodiment 1.

Figures 4A, 4B, 4C, 4D:
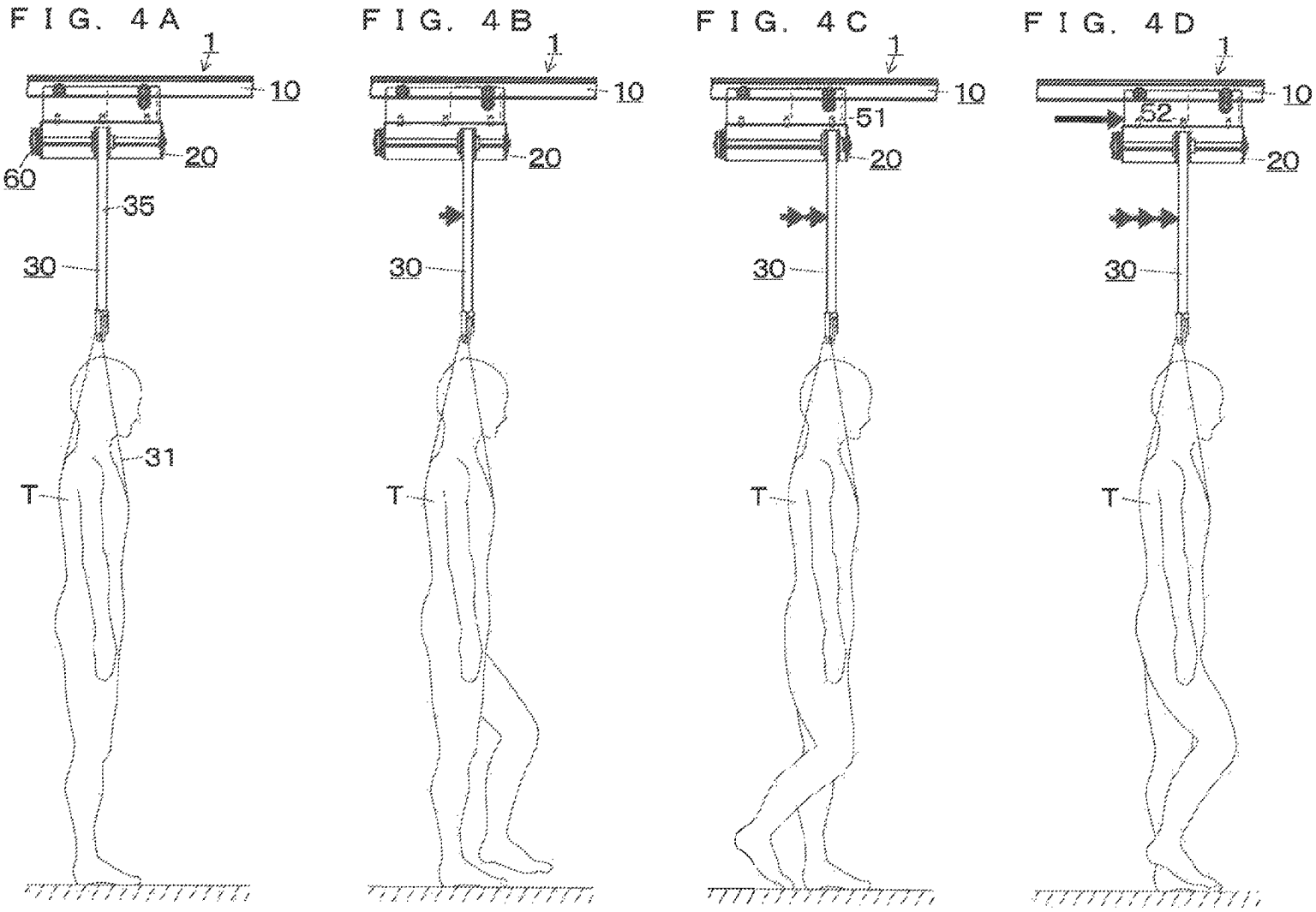
FIGS. 4A to 4D are side sectional views illustrating the body-weight-supported gait lift of the embodiment 1 and a gait trainee when gait training is performed with the body-weight-supported gait lift.
Figure 5A:
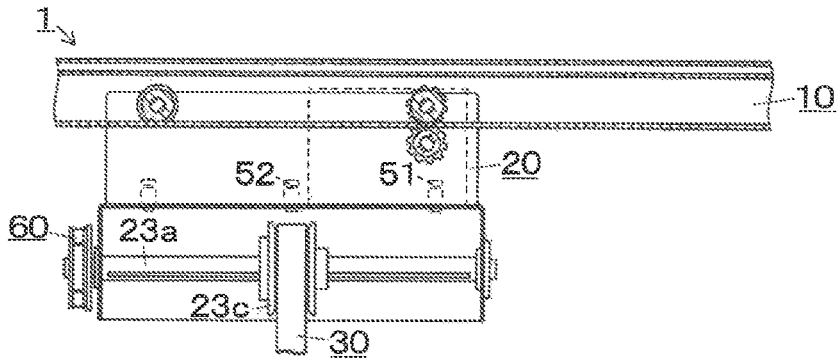
FIGS. 5A to 5D are side sectional views illustrating the body-weight-supported gait lift of the embodiment 1 when gait training is performed with the body-weight-supported gait lift.

[1] To begin with, as depicted in FIG. 4A and FIG. 5A, the gait trainee T wears the lifting device 30, and then the hoisting device 60 hoists the lifting device 30 appropriately, thereby lifting the gait trainee T appropriately to reduce part of body weight loaded on the legs of the gait trainee T.

Figure 5B:
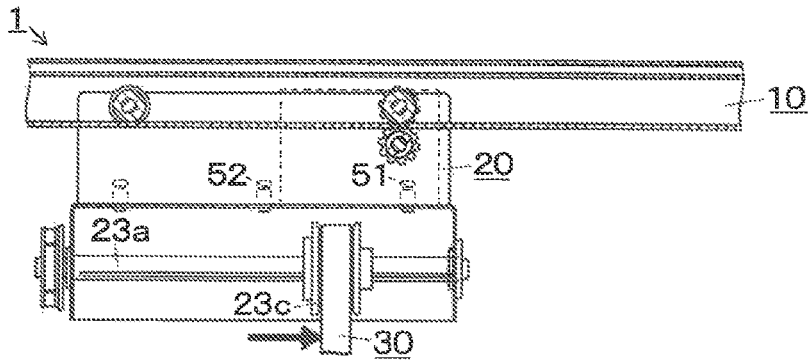

[2] Next, as depicted in FIG. 4B and FIG. 5B, the gait trainee T moves forward, whereby the reel 23*c* is relatively displaced forward with respect to the shaft 23*a*. At this time, because the reel 23*c* has not reached the forward position, the self-propelled device 40 does not operate, and thus the travel base 20 remains stationary.

Figure 5C:
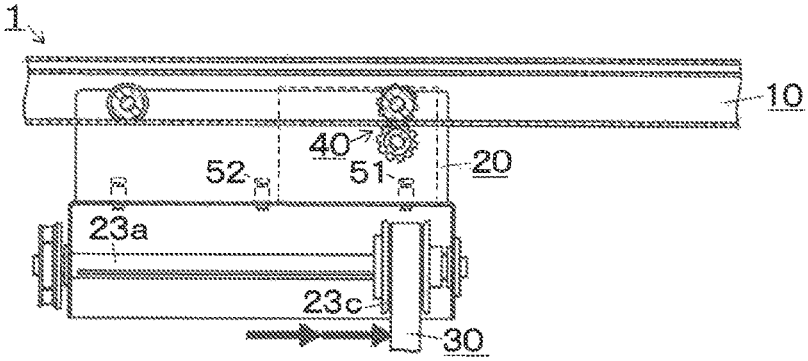

[3] Next, the gait trainee T further moves forward, whereby the reel 23*c* is further relatively displaced forward with respect to the shaft 23*a*. When the reel 23*c* has reached the forward position as depicted in FIG. 4C and FIG. 5C, the forward-movement sensor 51 detects this, and transmits a forward-movement signal to the controller (not depicted). Accordingly, the travel base 20 starts being self-propelled forward.

Figure 5D:
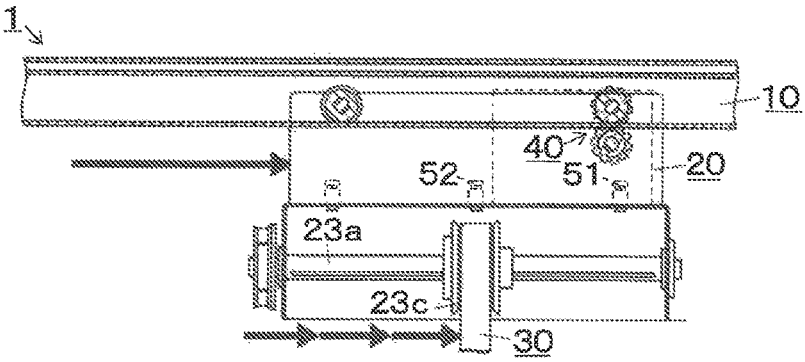

[4] The travel base 20 is then self-propelled forward faster than the gait trainee T moves, whereby the shaft 23*a* is relatively displaced forward with respect to the reel 23*c*. When the reel 23*c* has reached the reference position with respect to the shaft 23*a* as depicted in FIG. 4D and FIG. 5D, the stop sensor 52 detects this, and transmits a stop signal to the controller (not depicted). Accordingly, the travel base 20 stops being self-propelled forward.

[5] Subsequently, processes described in [2] to [4] above are repeated, and the travel base 20 is accordingly self-propelled forward in accordance with the pace of the gait trainee T.

[6] When the gait trainee T has walked to the front end of the rail 10, the gait trainee T turns around and walks rearward. The manner in which the gait trainee walks rearward is the same as that described in [2] to [5] above except the description of the drawings if the term "forward" is read as the term "rearward" and the "sensor 51" is read as the "sensor 53".

According to the present embodiment 1, the following effects [A] to [E] can be obtained.

[A] The travel base 20 can be self-propelled and the lifting device 30 can be relatively displaced in the front-and-rear direction with respect to the travel base 20 within the predetermined range. Accordingly, the gait trainee T does not apply forward force to the travel base 20 by himself/herself when moving forward and does not apply rearward force to the travel base 20 by himself/herself when moving rearward. Thus, force required to be applied forward when the gait trainee T moves forward and force required to be applied rearward when the gait trainee stops are not great.

[B] The control device 50 causes the travel base 20 to be self-propelled in accordance with the pace of the gait trainee T. Accordingly, the travel base 20 is self-propelled in accordance with the pace of the gait trainee T without manual operation of the travel base 20 by the gait trainee T in accordance with his/her pace. Thus, the gait trainee T can focus exclusively on walking.

[C] The lifting device 30 can be relatively displaced in the front-and-rear direction with respect to the travel base 20 within the predetermined range. Accordingly, even if the self-propelled speed of the travel base 20 does not perfectly match the pace of the gait trainee T, the gait trainee T is not pulled forward or rearward by the travel base 20 when the lifting device 30 is within the predetermined range. Furthermore, the shaft 23*a* and the reel 23*c* are engaged with each other via the rotation-preventing grooves 23*b*, 23*b*, 23*b* and the bearings B, B, B so that sliding resistance in the front-and-rear direction is minimized. Thus, even when receiving a slight force due to the sliding resistance, the gait trainee T is prevented from being pulled forward or rearward by the travel base 20 as much as possible.

[D] Since the control device 50 not only causes the travel base 20 to be self-propelled forward in accordance with the pace of the gait trainee T, but also causes the travel base 20 to be self-propelled rearward in the same manner, the gait trainee T can turn around and walk rearward when having moved to the front end of the rail 10. Thus, gait training can be performed efficiently and repeatedly.

[E] The control device 50 causes the travel base 20 to be self-propelled in accordance with the pace of the gait trainee T by repeating the processes [2] to [4] above. This allows dealing with a case in which the walking speed of the gait trainee T is unstable.

[F] Since the control device 50 causes the travel base 20 to be self-propelled in accordance with the pace of the gait trainee T by repeating the processes [2] to [4] above, the travel base 20 is always positioned above the head of the gait trainee T. Thus, the angle of the strap 35 of the lifting device 30 does not significantly deviate from the vertical direction, which enables the body weight of the gait trainee T to be stably supported upward.

[F] Since the control device 50 causes the travel base 20 to be self-propelled in accordance with the pace of the gait trainee T by repeating the processes [2] to [4] above, the travel base 20 is always positioned above the head of the gait trainee T. Thus, the angle of the strap 35 of the lifting device 30 does not significantly deviate from the vertical direction, which enables the body weight of the gait trainee T to be stably supported upward.

Example 2

Figure 6A:
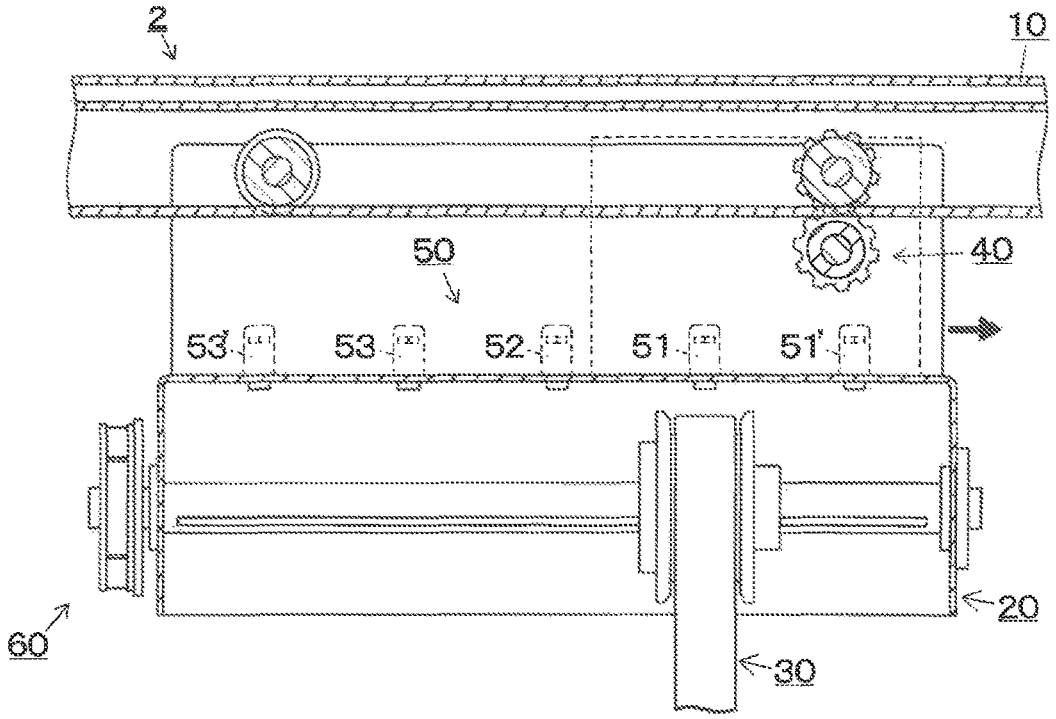
FIG. 6A is a side sectional view illustrating a body-weight-supported gait lift of an embodiment 2 during low-speed forward movement.
Figure 6B:
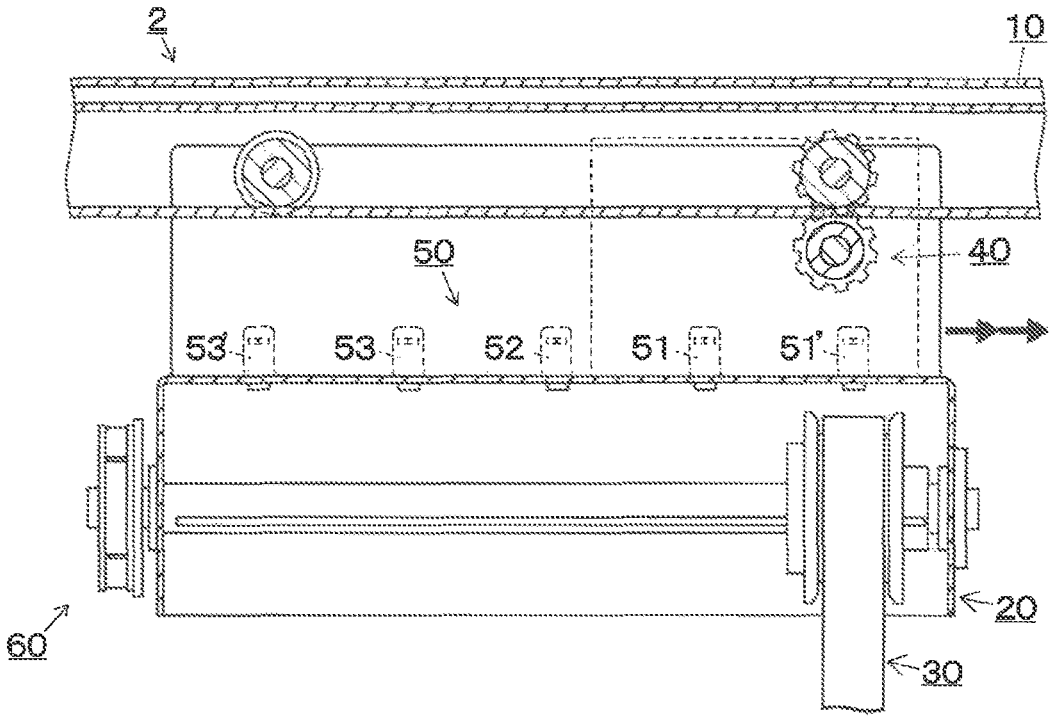
FIG. 6B is a side sectional view of the body-weight-supported gait lift during high-speed forward movement.

A body-weight-supported gait lift 2 of an embodiment 2 depicted in FIGS. 6A and 6B is different from the body-weight-supported gait lift 1 of the embodiment 1 in the following points [I] to [III], and is the same in the other points.

Point [I]: a second forward-movement sensor 51' is provided. The second forward-movement sensor 51' is an infrared sensor that detects with infrared rays that the reel 23*c* has reached a second forward position anterior to the forward position with respect to the shaft 23*a*, that is, the lifting device 30 has reached the second forward position anterior to the forward position with respect to the travel base 20, and that transmits a second forward-movement signal to the controller (not depicted). This second forward-movement sensor 51' is attached to an upper portion of the main frame 23 in a position anterior to the forward-movement sensor 51.

Point [II]: a second rearward-movement sensor 53' is provided. The second rearward-movement sensor 53' is an infrared sensor that detects with infrared rays that the reel 23*c* has reached a second rearward position posterior to the rearward position with respect to the shaft 23*a*, that is, the lifting device 30 has reached the second rearward position posterior to the rearward position with respect to the travel base 20, and that transmits a second rearward-movement signal to the controller (not depicted). This second rearward-movement sensor 53' is attached to an upper portion of the main frame 23 in a position posterior to the rearward-movement sensor 53.

Point [III]: the controller (not depicted) of the control device 50 causes the travel base 20 to be self-propelled forward at a relatively low speed (low-speed forward movement) when receiving a forward-movement signal from the forward-movement sensor 51, causes the travel base 20 to be self-propelled forward at a relatively high speed (high-speed forward movement) when receiving a second forward-movement signal from the second forward-movement sensor 51', causes the travel base 20 to be self-propelled rearward at a relatively low speed (low-speed rearward movement) when receiving a rearward-movement signal from the rearward-movement sensor 53, causes the travel base 20 to be self-propelled rearward at a relatively high speed (high-speed rearward movement) when receiving a second rearward-movement signal from the second rearward-movement sensor 53', and causes self-propelling of the travel base 20 to stop when receiving a stop signal.

According to the embodiment 2, in addition to the effects [A] to [F] above, the following effect can be obtained. That is, the control device 50 controls self-propelling of the travel base 20 in five stages of high-speed forward movement, low-speed forward movement, stop, low-speed rearward movement, and high-speed rearward movement. This enables the travel base 20 to be self-propelled in accordance with the pace of the gait trainee T more smoothly than in the case of the embodiment 1 in which the self-propelling is controlled in three stages of forward movement, stop, and rearward movement.

Example 3

A body-weight-supported gait lift 3 of an embodiment 3 depicted in FIGS. 7A to 7D is different from the body-weight-supported gait lift 1 of the embodiment 1 in the following points [IV] and [V], and is the same in the other points.

Point [IV]: the stop sensor 52 is not provided.

Figure 7A:
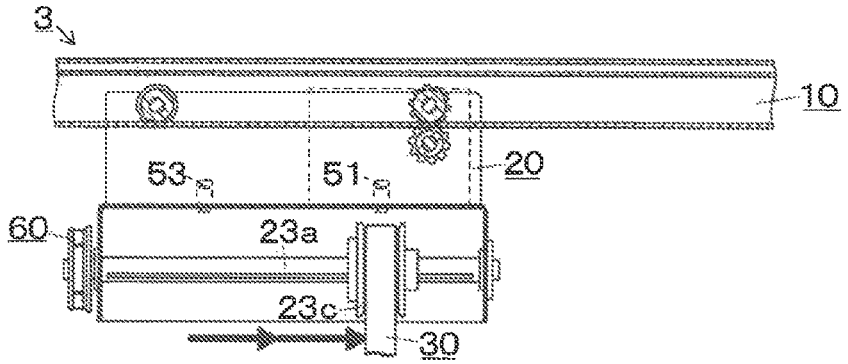
FIGS. 7A and 7B are side sectional views illustrating the body-weight-supported gait lift of an embodiment 3 in a forward-movement mode.
Figure 7B:
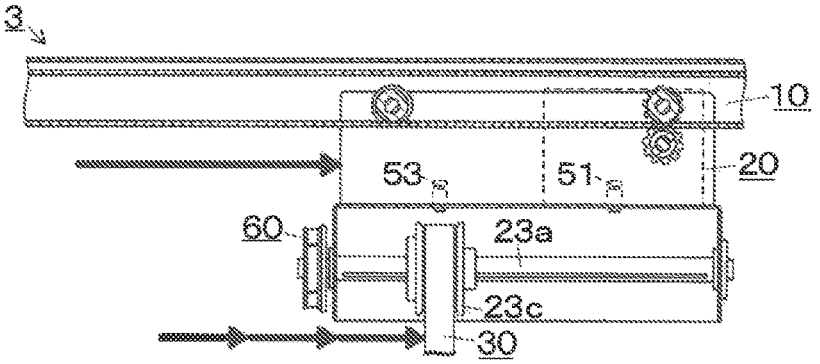
Figure 7C:
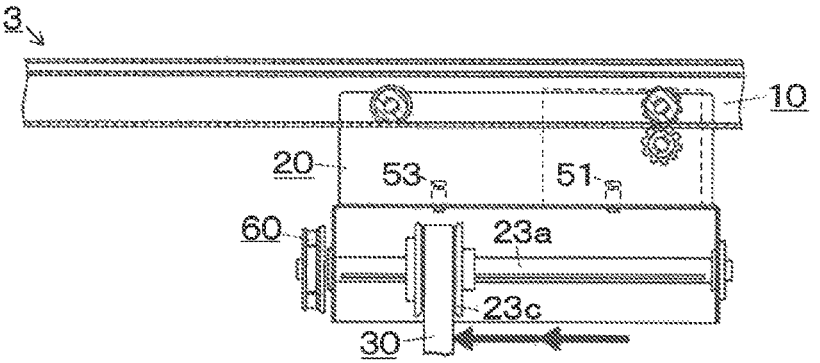
FIGS. 7C and 7D are side sectional views of the body-weight-supported gait lift in a rearward-movement mode.
Figure 7D:
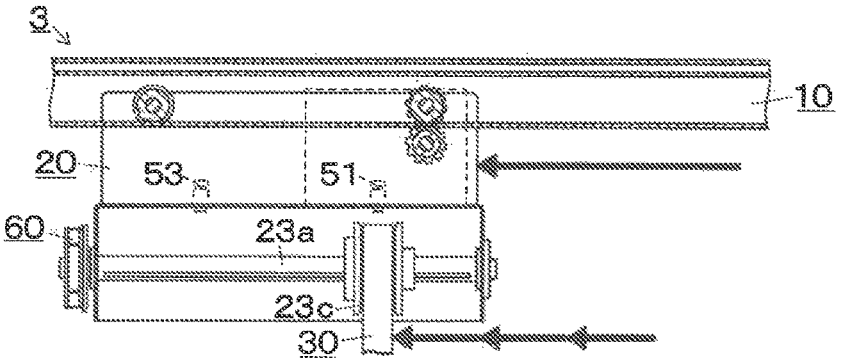
Figure 8:
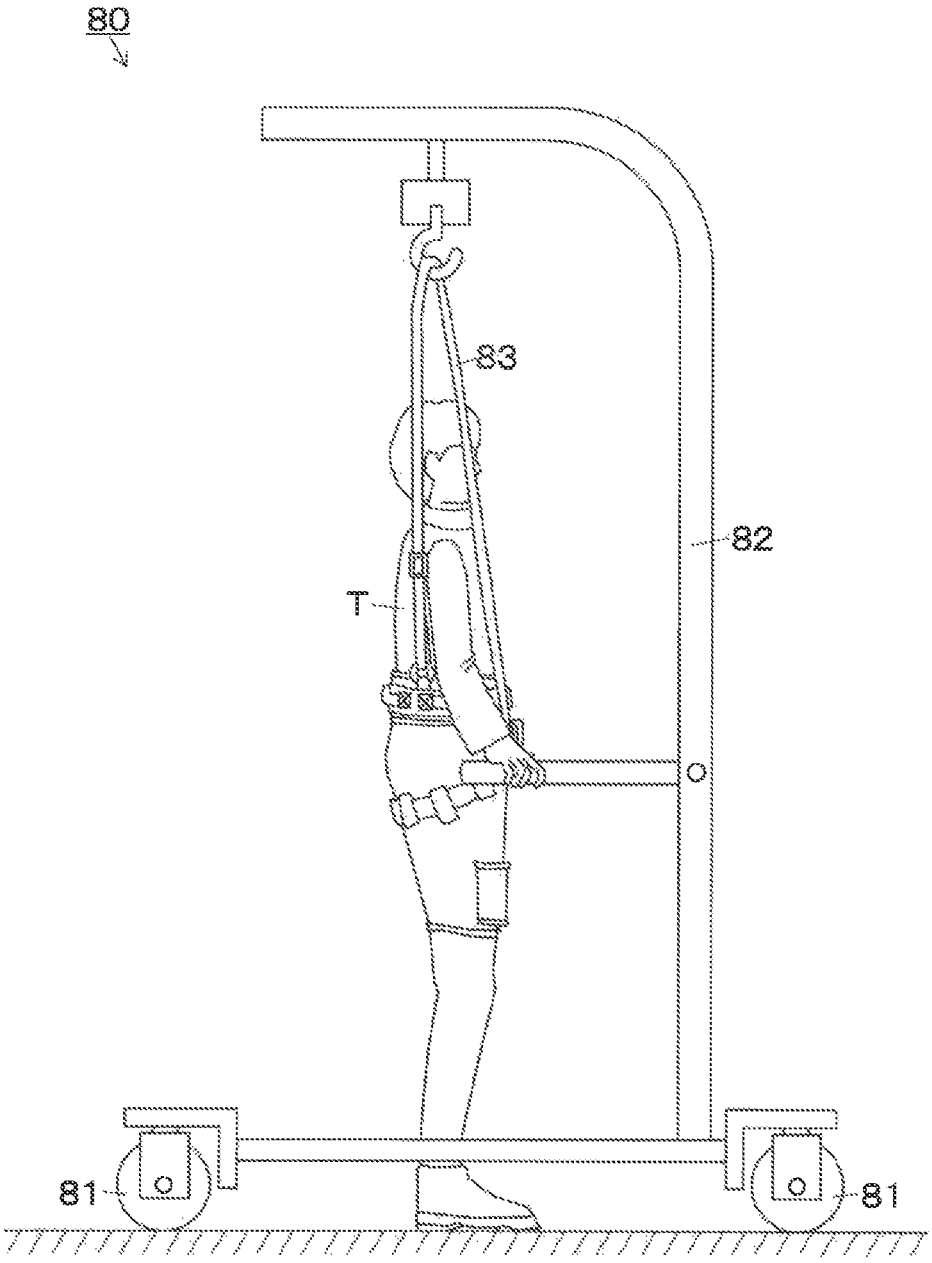
FIG. 8 PRIOR ART
FIG. 8 is a side view illustrating a body-weight-supported gait lift of a conventional example 1.
Figures 9A, 9B, 9C, 9D:
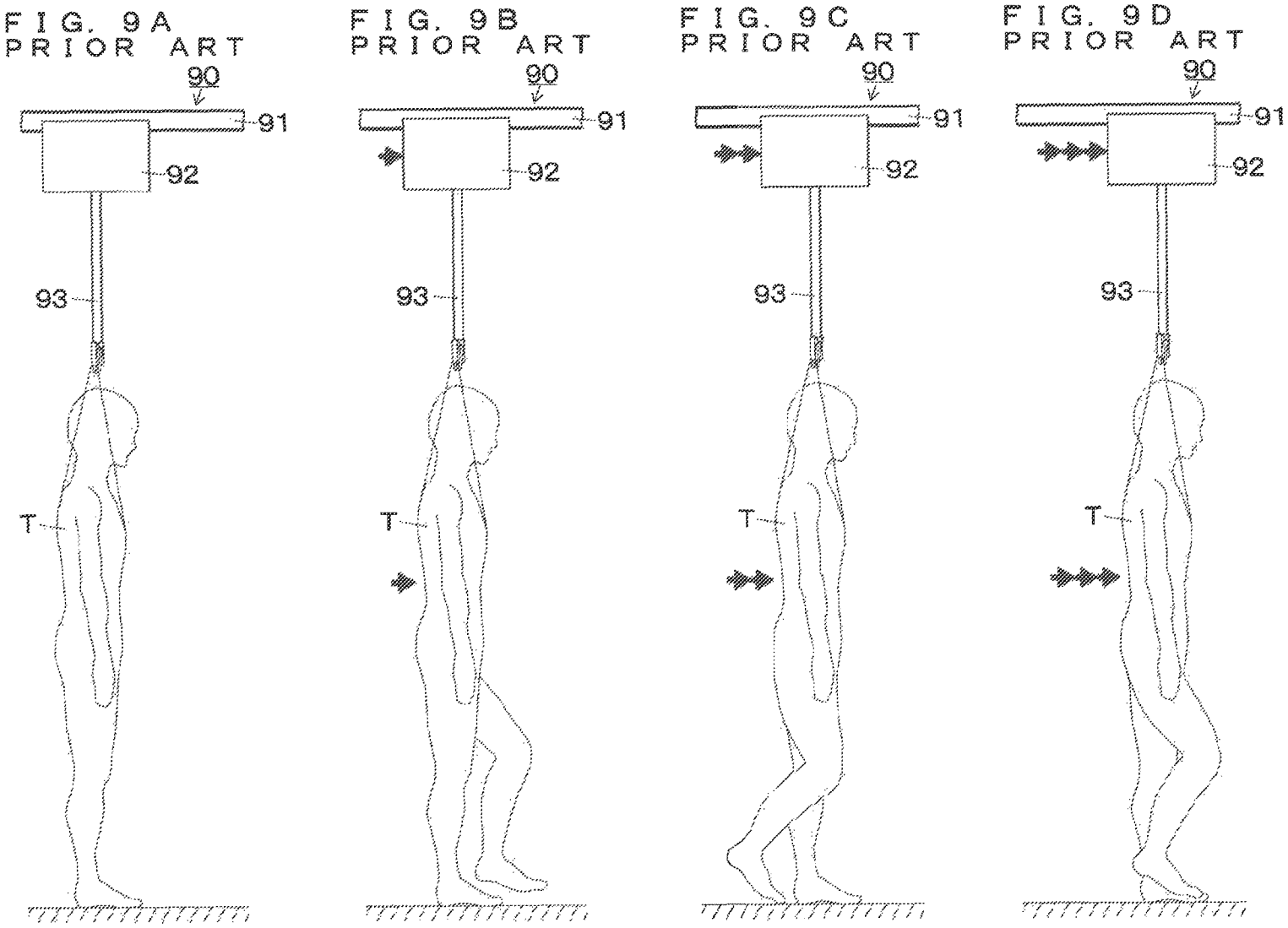
FIG. 9A PRIOR ART
FIG. 9B PRIOR ART
FIG. 9C PRIOR ART
FIG. 9D PRIOR ART
FIGS. 9A to 9D are side views illustrating a body-weight-supported gait lift of a conventional example 2 and a gait trainee when gait training is performed with the body-weight-supported gait lift.
Figure 10B:
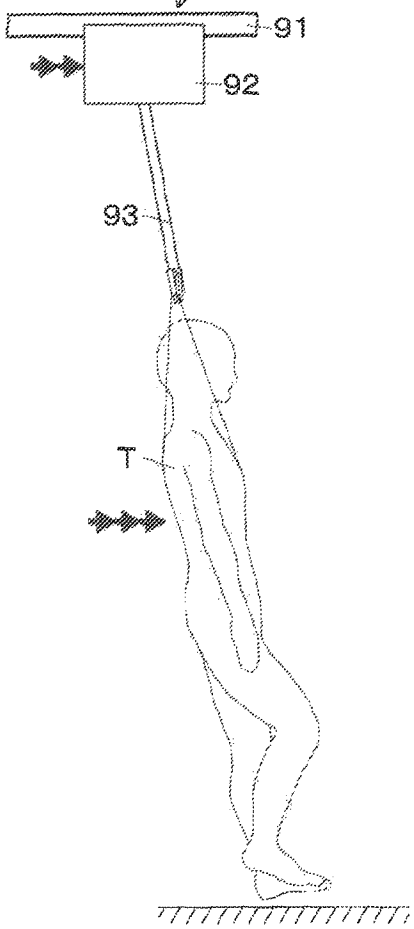
FIG. 10B PRIOR ART
FIG. 10B is a side view illustrating a situation in which the gait trainee is pulled rearward.
Figure 10A:
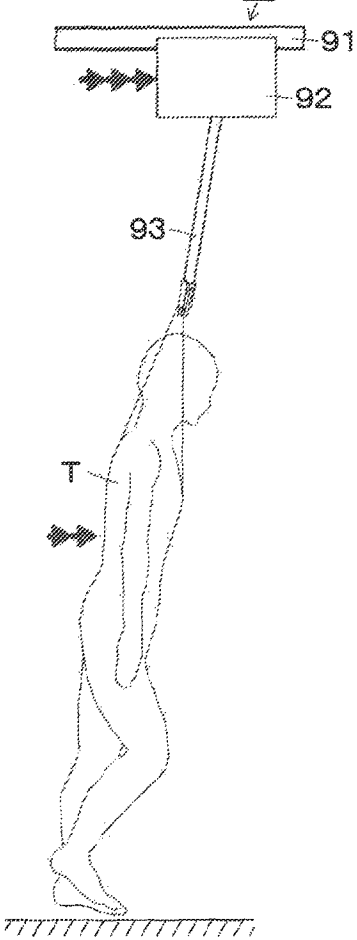
FIG. 10A PRIOR ART
FIG. 10A is a side view illustrating a situation in which the gait trainee is pulled forward by the body-weight-supported gait lift of the conventional example 2.

Point [V]: in a predetermined forward-movement mode depicted in FIGS. 7A and 7B, the controller (not depicted) of the control device 50 causes the travel base 20 to be self-propelled forward when receiving a signal from the forward-movement sensor 51 as depicted in FIG. 7A, and causes self-propelling of the travel base 20 to stop when receiving a signal from the rearward-movement sensor 53 as depicted in FIG. 7B; and in a predetermined rearward-movement mode depicted in FIGS. 7C and 7D, the control device 50 causes the travel base 20 to be self-propelled rearward when receiving a signal from the rearward-movement sensor 53 as depicted in FIG. 7C, and causes self-propelling of the travel base 20 to stop when receiving a signal from the forward-movement sensor 51 as depicted in FIG. 7D. The movement mode may be switched between the forward-movement mode and the rearward-movement mode by manual operation, or may be switched therebetween automatically when the gait trainee T has moved forward to the front end of the rail 10 and when the gait trainee has moved rearward to the rear end thereof.

According to the embodiment 3, in addition to the effects [A] to [F] above, the following effect can be obtained. That is, even though the stop sensor 52 described in the embodiment 1 is not provided, the travel base 20 can be caused to move forward and move rearward in accordance with the pace of the gait trainee T by switching between the forward-movement mode and the rearward-movement mode only with two sensors of the forward-movement sensor 51 and the rearward-movement sensor 53. Thus, the structure can be more simplified than in the case of the embodiment 1, and also the cost can be reduced.

It should be noted that the present invention is not limited to the examples 1 to 3, and may be appropriately modified and embodied without departing from the gist of the invention.

REFERENCE SIGNS LIST

1 Body-weight-supported gait lift (Example 1)
2 Body-weight-supported gait lift (Example 2)
3 Body-weight-supported gait lift (Example 3)
10 Rail
20 Travel base
23*a* Shaft
30 Lifting device
50 Control device
51 Forward-movement sensor
52 Stop sensor
53 Rearward-movement sensor
60 Hoisting device
T Gait trainee

The invention claimed is:

1. A body-weight-supported gait lift, comprising:

a rail that is provided in a position above a head of a gait trainee and extends in a front-and-rear direction;

a travel base that is attached to the rail in a manner capable of being self-propelled;

a lifting device that is hung on the travel base and lifts the gait trainee to reduce a part of a body weight of the gait trainee loaded on legs of the gait trainee, wherein the lifting device is hung in a manner relatively displaceable in the front-and-rear direction with respect to the travel base within a predetermined range; and a control device that causes the travel base to be self-propelled forward when the gait trainee moves forward and the lifting device is relatively displaced forward with respect to the travel base within the predetermined range, and causes self-propelling of the travel base to stop when the travel base is self-propelled forward faster than the gait trainee moves and then the lifting device is relatively displaced rearward with respect to the travel base within the predetermined range, thereby causing the travel base to be self-propelled forward in accordance with a pace of the gait trainee, wherein a hoisting device that hoists the lifting device is attached to the travel base, wherein the travel base includes a shaft extending in the front-and-rear direction, wherein an upper portion of lifting device is engaged with the shaft in a manner relatively displaceable in the front-and-rear direction and relatively non-displaceable in a circumferential direction so that the lifting device is hung on the travel base, and wherein the hoisting device rotates the shaft to hoist the lifting device.

2. The body-weight-supported gait lift according to claim 1, wherein the control device causes the travel base to be self-propelled rearward when the gait trainee moves rearward and the lifting device is relatively displaced rearward with respect to the travel base within the predetermined range, and causes self-propelling of the travel base to stop when the travel base is self-propelled rearward faster than the gait trainee moves and then the lifting device is relatively displaced forward with respect to the travel base within the predetermined range, thereby causing the travel base to be self-propelled rearward in accordance with the pace of the gait trainee.

3. The body-weight-supported gait lift according to claim 2, wherein the control device includes:

a stop sensor that detects when the lifting device has reached a predetermined reference position with respect to the travel base;

a forward-movement sensor that detects when the lifting device has reached a forward position anterior to the predetermined reference position; and a rearward-movement sensor that detects when the lifting device has reached a rearward position posterior to the predetermined reference position, and wherein the travel base is self-propelled forward upon detection by the forward-movement sensor, the travel base is self-propelled rearward upon detection by the rearward-movement sensor, and self-propelling of the travel base is stopped upon detection by the stop sensor.

4. The body-weight-supported gait lift according to claim 2, wherein the control device includes:

a forward-movement sensor that detects when the lifting device has reached a predetermined forward position with respect to the travel base; and a rearward-movement sensor that detects when the lifting device has reached a rearward position posterior to the predetermined forward position, wherein, in a predetermined forward-movement mode, the travel base is configured to be self-propelled forward upon detection by the forward-movement sensor and self-propelling of the travel base is stopped upon detection by the rearward-movement sensor, and wherein, in a predetermined rearward-movement mode, the travel base is confirmed to be self-propelled rearward upon detection by the rearward-movement sensor and self-propelling of the travel base is stopped upon detection by the forward-movement sensor.

5. The body-weight-supported gait lift according to claim 1, wherein the hosting device rotates the shaft in the circumferential direction to hoist the lifting device.

6. The body-weight-supported gait lift according to claim 1, wherein the hoisting device includes:

a hoisting motor as a power source for hoisting the lifting device; and a hoisting-force transmission mechanism that transmits a power of the hoisting motor to the shaft to rotate the shaft in the circumferential direction.

7. The body-weight-supported gait lift according to claim 6, wherein the hoisting-force transmission mechanism includes:

a first pulley attached to a rear-end portion of the hoisting motor;

a second pulley attached to a rear-end portion of the shaft to rotate together with the shaft; and a belt that is looped over the first pulley and the second pulley to transfer the power of the hoisting motor to the shaft.

8. The body-weight-supported gait lift according to claim 1, further comprising:

a hoisting-device supporting protrusion that extends in a direction orthogonal to the longitudinal direction of an extension of the travel base.

9. The body-weight-supported gait lift according to claim 8, wherein, below the travel base, the hoisting device is attached to the hoisting-device supporting protrusion.

10. The body-weight-supported gait lift according to claim 1, wherein, on an outer peripheral surface of the shaft, rotation-preventing grooves are recessed and extend in the front-and-rear direction.

11. The body-weight-supported gait lift according to claim 10, further comprising:

a reel attached to the shaft in the manner relatively displaceable in the front-and-rear direction and relatively non-displaceable in the circumferential direction, wherein the rotation-preventing grooves are engaged with the reel for displacing the lifting device in the front-and-rear direction.

* * * * *